US006360439B1

(12) United States Patent
Cleland et al.

(10) Patent No.: US 6,360,439 B1
(45) Date of Patent: Mar. 26, 2002

(54) METHOD OF MANUFACTURING AN ORIFICE PLATE HAVING A PLURALITY OF CLOSED SLITS

(75) Inventors: Todd A. Cleland; Garrard Hume, both of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/130,179

(22) Filed: Aug. 5, 1998

Related U.S. Application Data

(62) Division of application No. 08/900,157, filed on Jul. 28, 1997, now Pat. No. 5,847,725.

(51) Int. Cl.[7] ..... B21D 53/76; C25D 1/08

(52) U.S. Cl. ..... 29/890.1; 29/611; 29/896.6; 205/75

(58) Field of Search ..... 29/890.1, 611, 29/896.6; 428/913; 347/20, 47, 45; 205/75

(56) References Cited

U.S. PATENT DOCUMENTS

| | | | | |
|---|---|---|---|---|
| 4,994,825 A | | 2/1991 | Saito et al. | |
| 5,069,978 A | | 12/1991 | Mizuhara | |
| 5,167,776 A | * | 12/1992 | Bhaskar et al. | 205/25 |
| 5,194,877 A | | 3/1993 | Lam et al. | |
| 5,230,459 A | | 7/1993 | Mueller et al. | |
| 5,443,713 A | | 8/1995 | Hindman | 205/70 |
| 5,506,608 A | | 4/1996 | Marler et al. | 347/18 |
| 5,560,837 A | * | 10/1996 | Trueba | 216/27 |

* cited by examiner

*Primary Examiner*—Lee Young
*Assistant Examiner*—A. Dexter Tugbang

(57) ABSTRACT

A method of manufacturing an orifice plate for a fluid ejection device comprises defining a plurality of orifice apertures in a substantially planar plate; and defining a plurality of closed slits in the plate.

10 Claims, 4 Drawing Sheets

METHOD OF MANUFACTURING AN ORIFICE PLATE HAVING A PLURALITY OF CLOSED SLITS

CROSS REFERENCE TO RELATED APPLICATION

This is a divisional of application Ser. No. 08/900,157 filed on Jul. 28, 1997, now U.S. Pat. No. 5,847,725.

FIELD OF THE INVENTION

This invention relates to orifice plates for fluid ejection devices, and more particularly to methods for manufacturing an orifice plate having a plurality of closed slits.

BACKGROUND OF THE INVENTION

Ink jet printing mechanisms use pens that shoot droplets of colorant onto a printable surface to generate an image. Such mechanisms may be used in a wide variety of applications, including computer printers, plotters, copiers, and facsimile machines. For convenience, the concepts of the invention are discussed in the context of a printer. An ink jet printer typically includes a print head having a multitude of independently addressable firing units. Each firing unit includes an ink chamber connected to a common ink source via channels in a substrate, to an ink outlet nozzle defined in a thin metal orifice plate common to all nozzles on a print head.

In some configurations, a three color pen has three different channels running parallel to each other and nearly spanning the entire substrate. Print heads are assembled by registering the corresponding rows of orifices with the ink channels in the substrate. The orifice plate is attached to the substrate with a barrier layer that serves as an adhesive gasket to isolate the orifices and ink channels from each other to prevent cross leakage. The adhesion is conducted under pressure and at elevated temperature. Because the metal plate has a greater coefficient of thermal expansion than the silicon substrate, thermal stresses are generated when the print head equilibrates at room temperature. The silicon substrate is normally strong enough to withstand the compressive forces generated by the stress in the print head, except that the ink channels weaken the substrate against forces perpendicular to the channels. With larger sized print head substrate dies, unwanted warpage may occur. When the assembled wafers are sawed apart into separate print head dies, chipping or wafer breakage may occur due to thermal stresses. Some breakage can be avoided by sawing at slower feed rates, but this increases manufacturing time and costs.

DETAILED DESCRIPTION

Figure 1:
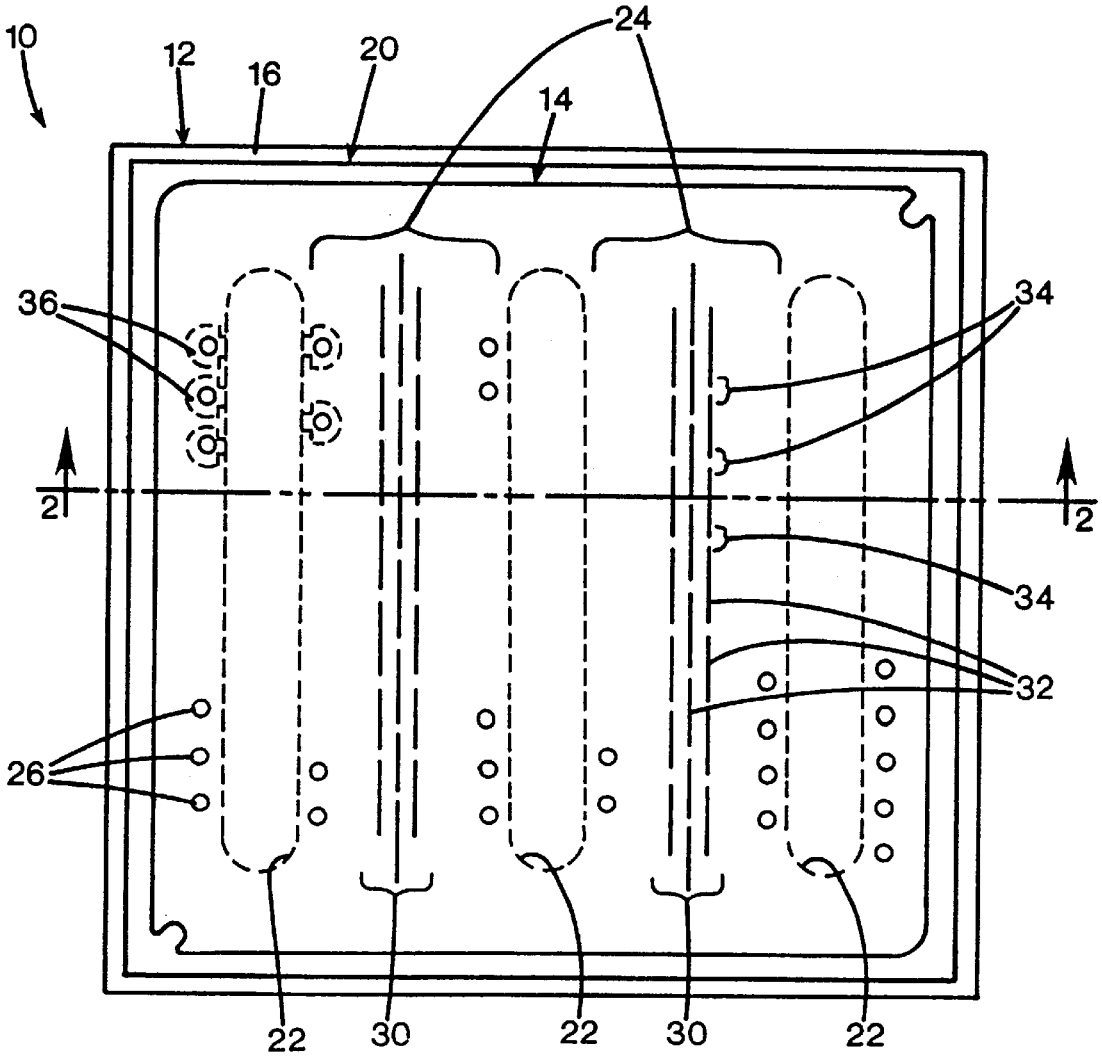
FIG. 1 is a plan view of an ink jet print head according to a preferred embodiment of the invention.
Figure 2:
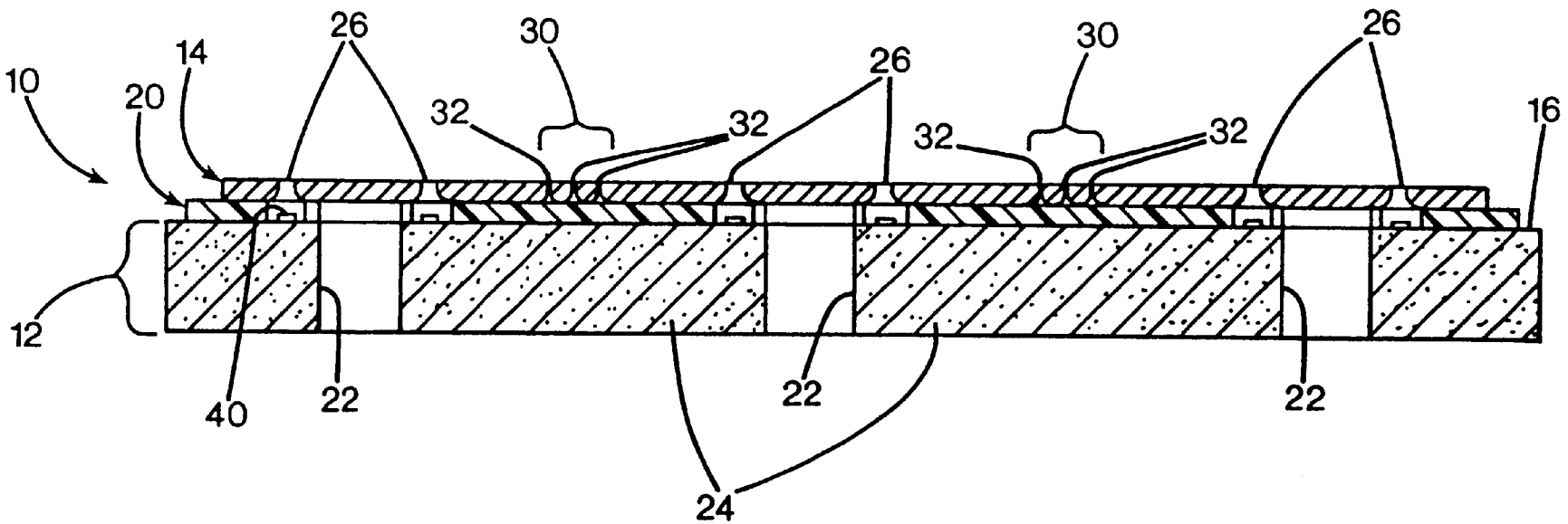
FIG. 2 is a sectional side view of the print head of FIG. 1 taken along line 2—2.

FIGS. 1 and 2 show an ink jet print head 10 having a planar silicon die 12 providing a substrate for a metal orifice plate 14, which is laminarly adhered to a front surface 16 of the die with a polymeric barrier film layer 20. The die 12 defines three elongated ink channels 22 that are evenly spaced apart on the die, and which pass entirely through the thickness of the die to communicate with corresponding separate color ink reservoirs connected at the rear of the die. A solid, broad septum 24 of the die separates each adjacent pair of channels A the plate 14 defines a row of ink orifices 26 on each side of each channel 22. For each channel, the rows on opposite sides are offset from each other so that an evenly spaced swath may be printed by firing all orifices on both sides. At an intermediate position above each die septum 24, the die defines an elongated array 30 of expansion relief slits 32. Each array 30 includes three adjacent parallel rows of slits in closely spaced end-to-end relation. The arrays 30 are parallel to the direction of the ink channels, centered between the adjacent channels, and span a major portion of the plate.

The adjacent rows of slits in each array are linearly offset from each other. Each row has solid webs 34 between linearly adjacent slits to provide integrity and strength. The slits of the center row of each array are each registered with the webs of the outer rows, so that the array stretches in response to application of tension perpendicular to the array and in the plane of the plate, in the manner of conventional expanded metal mesh.

The barrier layer 20 is coextensive with the die 12 and plate 14, except that it defines openings registered with the ink channels 22, with pockets 36 extending away from the channel, one for each orifice 26. A firing resistor 40 on the front surface of the is positioned beneath each orifice.

Figure 3:
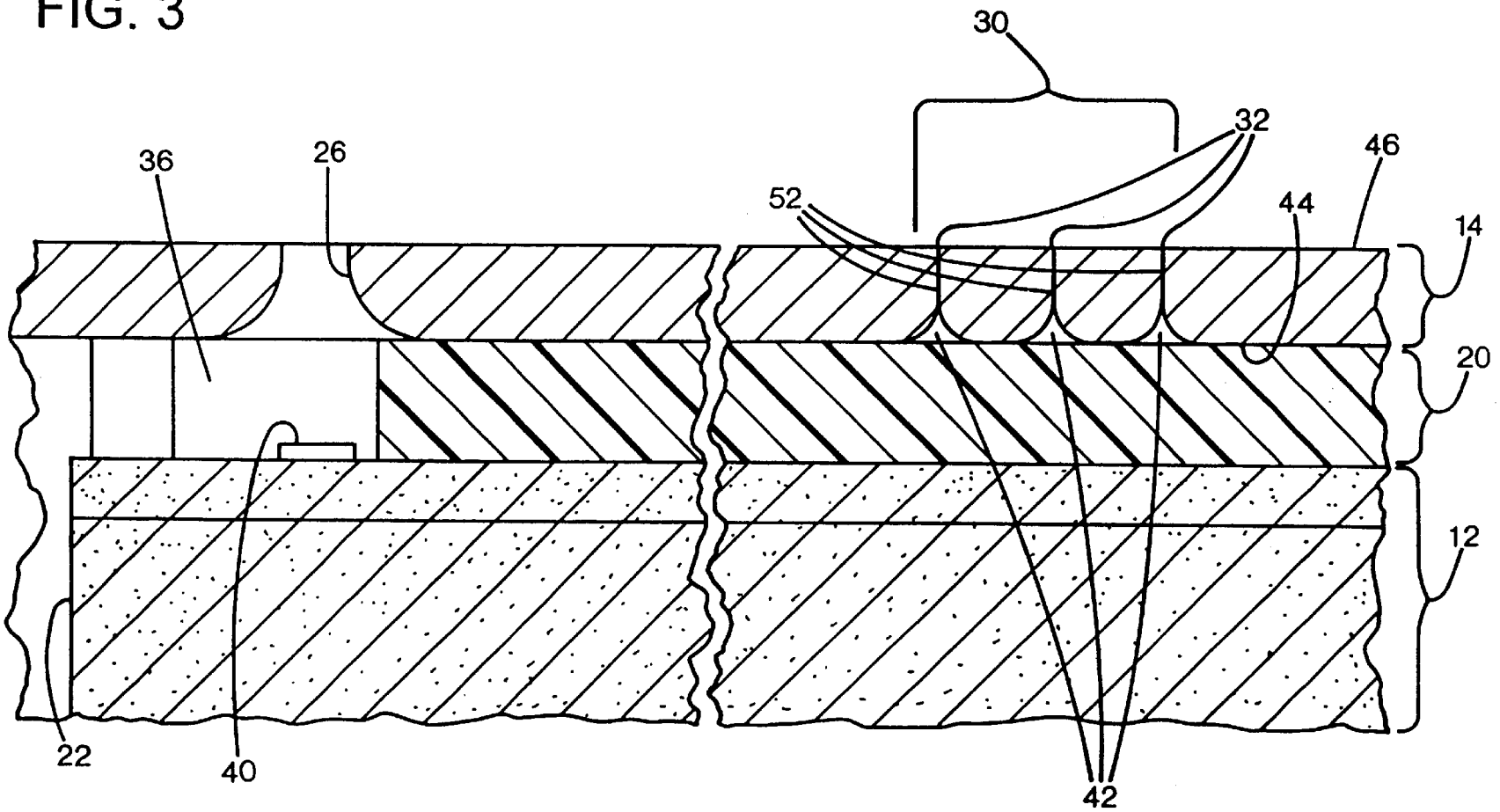
FIG. 3 is an enlarged sectional side view of the print head of FIG. 1.

FIG. 3 shows the features of the print head in greatly enlarged detail. In the preferred embodiment, the die 12 has a thickness of about 675 $\mu$m and sides of length 7855 $\mu$m by 8685 $\mu$m. The channels 22 are approximately 5690 $\mu$m long and 300 $\mu$m wide, with the septums 24 being about 2 mm wide. The entire print head has 192 resistors, with 32 being spaced in a row on each side of each ink channel at a pitch of 150 per inch. The barrier is formed of a polyimide material, and is 19 $\mu$m thick. The plate 14 is a palladium-coated nickel plate of 50 $\mu$m thickness, with the orifices having a diameter of 27 $\mu$m at the front surface of the plate. The slits are each about 1300 $\mu$m long, and are typically arranged with 5 in each row. The slit arrays 30 extend to within about 1000 $\mu$m of the edge of the plate, and are spaced apart from adjacent rows by approximately 300 $\mu$m.

Figure 4:
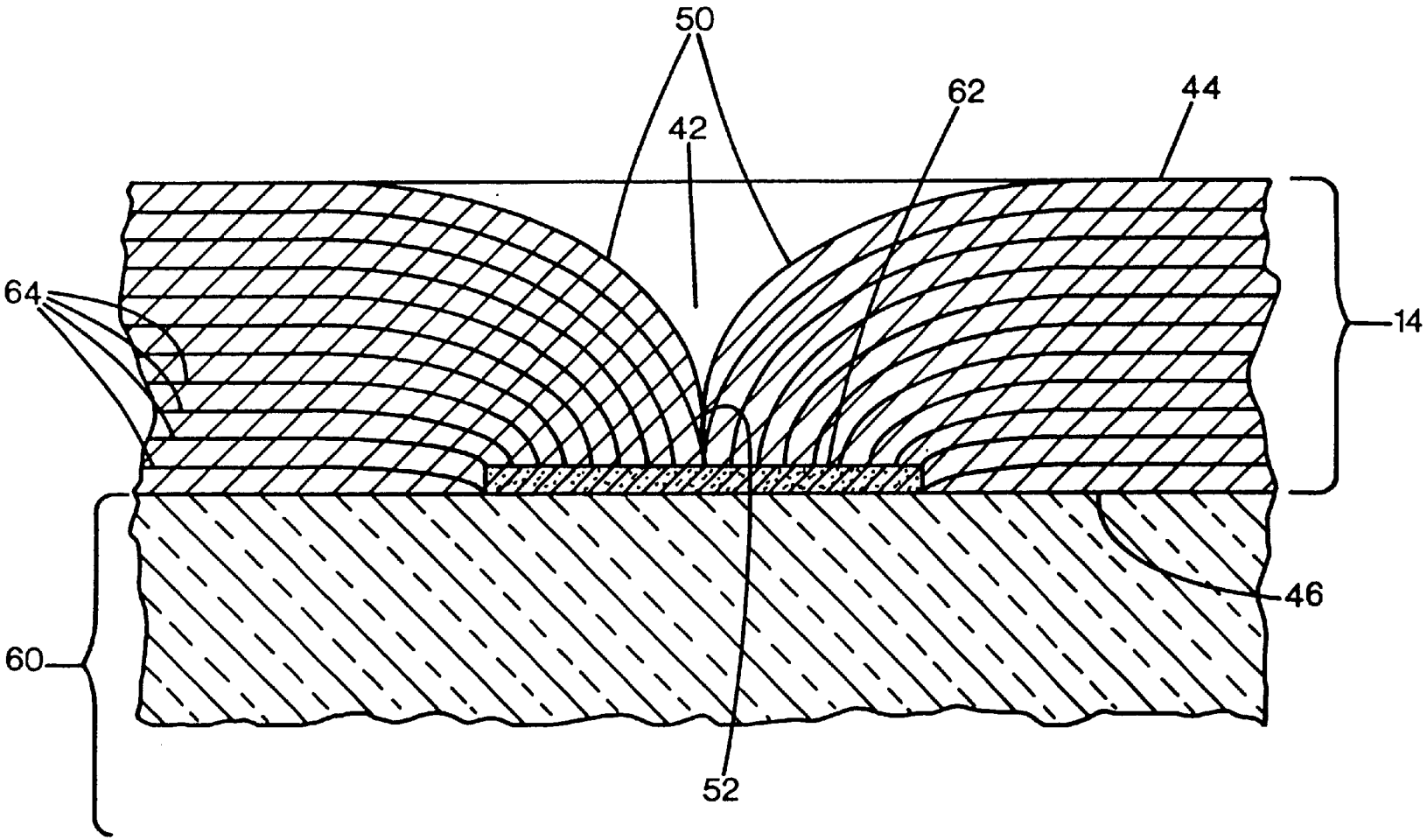
FIG. 4 is an enlarged sectional side view of the print head of FIG. 1 showing a manufacturing process.

As seen in cross section taken perpendicular to its length, each slit defines a groove 42 opening to the lower surface 44 of the plate opposite the upper surface 46. As shown in FIG. 4, each groove is defined by opposed convex cylindrical side surfaces 50 that are tangent to each other and to the lower surface on opposite sides of the slit. Essentially, the lower surface 44 is flat until it approaches a slit, where it curves smoothly downward into the slit from each side to meet the opposite. Where the curved surfaces 50 meet, they approach perpendicular to the plane of the plate and abut each other at a knit line 52 that extends to the front surface 46 as shown in FIG. 1. The front surface is flat near the knit line, which extends to between ⅓ to ½ the thickness of the plate.

As illustrated in FIG. 4, the plate is manufactured by applying Nickel plating to a glass mandrel sheet 60. Where a slit feature is to be formed, a plating resistive pattern element 62 of a thin layer of silicon carbide has been applied to the mandrel. Plating occurs progressively, as illustrated schematically by the layers 64 that form the plate. Although plating occurs continuously and no distinct layers are actually formed in the preferred embodiment, the layers show how the thickness of the plate grows as viewed at even time intervals during the plating process.

At the surface of the mandrel, the plating applied initially actually adheres only to the glass and not to the pattern element 62. Each successive time interval's plating adheres to the existing plating and adds an incremental thickness. At the edge of the plating near the plating resistive element 62, the plating begins to obscure the edges of the element. During each time interval, the plating advances across the element by the amount it thickens in other regions. This forms a radiused advancing "toe" cross section as illustrated. When the plating thickness elsewhere has reached a thickness equal to half the width of the plating resistive element, the opposed "toes" meet to abut at the knit line 52. Because the plating process adds thickness only to exposed surfaces, the sharply angled deep V-groove 42 remains preserved as plating proceeds for a limited time after the sides meet, to ensure that the plating resistive element is fully obscured and the slit closed.

It is believed that the opposite sides of the slit do not fully fuse, permitting them to be separated slightly under the tension forces set up during assembly to relieve stresses. However, even if an alternative manufacturing approach were used to achieve a similar structure, the sharp groove apex would serve to concentrate stresses at a point of inherent weakness to ensure that any crack would form at that location before damage occurred elsewhere in the print head.

In the preferred embodiment, the plating resistive layer which defines the slit has a width of about 95 $\mu$m, and the plate is plated to a thickness of about 50 $\mu$m, ensuring that there is no substantial gap at the slit. The thickness of the plating resistive element 62 is 3500 Å, which is thin enough that the entire upper surface 46 may be considered as flat. The plates are formed in an array on a large sheet, and them broken apart for separate attachment to the substrates that are connected to each other in wafer form.

To assemble the print head, a barrier sheet is placed on each print head die with an orifice plate on top. The sandwich is subjected to 150 psi for 10 minutes at 200 C., followed by a bake process for 60 minutes at 220 C. After baking is complete, the wafer is allowed to cool to room temperature. As the plate has a thermal expansion coefficient of $13\times10^{-6}$/°C., compared to $3\times10^{-6}$/°C. for the silicon substrate, it will shrink by 15.5 $\mu$m more than the substrate, as measured along the edge perpendicular to the ink channels. Some of this stress is relieved by expansion of the slits, the slits open to a very small gap of up to about 2000 Å. With respect to the intrusion of even an aggressive low surface tension ink, this gap is so small as to be nonexistent and effectively closed to wicking or other means of entry by ink droplets. This protects the barrier layer beneath the slits from weakening and dissolution by the ink, which would possibly lead to delamination of the plate from the substrate. In addition, the sharp edges defining the knit line at the upper surface help to prevent wicking that might more readily occur in a tapered groove.

Because the substrate die 12, with a thickness of 675 $\mu$m is strong enough to withstand stresses longitudinal with the ink channels, no stress relieving slits are needed perpendicular to that direction. However, in alternative designs, slits may be oriented individually or in arrays in any direction based on the stresses that must be relieved.

While the above is discussed in terms of preferred and alternative embodiments, the invention is not intended to be so limited.

What is claimed is:

1. A method of manufacturing an orifice plate for a thermal ink jet print head comprising:

providing a mandrel with a plating receptive surface;

generating a first pattern of orifice elements of a first plating resistant material on the surface;

generating a second pattern of strain relief elements of a second plating resistant material on the surface; and progressively plating an orifice plate material onto the mandrel, including covering each of the strain relief elements with orifice plate material, and maintaining at least an exposed portion of each of the orifice elements, such that the orifice plate defines a plurality of orifices and is enclosed at the strain relief elements, wherein generating the orifice elements includes generating elements having a preselected width, and wherein generating the strain relief elements includes generating elongated elements having a width less than the width of the orifice elements.

2. A method of manufacturing an orifice plate for a thermal ink jet print head comprising:

providing a mandrel with a plating receptive surface;

generating a first pattern of orifice elements of a first plating resistant material on the surface;

generating a second pattern of strain relief elements of a second plating resistant material on the surface; and progressively plating an orifice plate material onto the mandrel, including covering each of the strain relief elements with orifice plate material, and maintaining at least an exposed portion of each of the orifice elements, such that the orifice plate defines a plurality of orifices and is enclosed at the strain relief elements, wherein plating includes generating a plurality of closed slits at the strain relief elements.

3. The method of claim 2 wherein generating the plurality of strain relief elements includes generating a first row of straight, elongated elements aligned on a common line.

4. The method of claim 3 including generating a second row of strain relief elements adjacent the first row.

5. The method of claim 4 wherein generating the second row of strain relief elements includes positioning the centers of each second row element offset from the centers of the first row elements.

6. The method of claim 2 wherein plating includes overlapping the strain relief elements such that the strain relief elements are fully covered.

7. The method of claim 6 wherein plating includes progressively obscuring the strain relief clement from its periphery to its center.

8. The method of claim 2 wherein each strain relief element is an elongated element with a selected width, and wherein plating includes plating to a thickness at least half as great as the width of the strain relief element, such that the strain relief element is obscured.

9. The method of claim 2 wherein the strain relief elements are shaped differently from the orifice elements.

10. A method of manufacturing an orifice plate for a thermal ink jet print head comprising:

providing a mandrel with a plating receptive surface;

generating a first pattern of orifice elements of a plating resistant material on the surface;

generating a second pattern of strain relief elements of the plating resistant material on the surface; and progressively plating an orifice plate material onto the mandrel, including covering each of the strain relief elements with orifice plate material, and maintaining at least an exposed portion of each of the orifice elements, such that the orifice plate defines a plurality of orifices and is enclosed at the strain relief elements, wherein plating includes generating a plurality of grooves, each one of the grooves corresponding to one of the strain relief elements.

* * * * *